US006548924B2

(12) United States Patent
Furukawa et al.

(10) Patent No.: US 6,548,924 B2
(45) Date of Patent: Apr. 15, 2003

(54) PROTECTIVE DEVICE FOR A HERMETICALLY SEALED TYPE COMPRESSOR AND A HERMETICALLY SEALED COMPRESSOR LISTING SAME

(75) Inventors: Hideharu Furukawa, Plainville, MA (US); Yoshihiko Ishikawa, Tokyo (JP); Toshio Shimada, Fujioka-machi (JP); Wataru Sugawara, Oohira-machi (JP)

(73) Assignees: Texas Instruments Incorporated, Dallas, TX (US); Hitachi, Ltd., Tokyo (JP)

( * ) Notice: Subject to any disclaimer, the term of this patent is extended or adjusted under 35 U.S.C. 154(b) by 0 days.

(21) Appl. No.: 09/870,064

(22) Filed: May 30, 2001

(65) Prior Publication Data

US 2001/0048285 A1 Dec. 6, 2001

(30) Foreign Application Priority Data

Jun. 6, 2000 (JP) ..... 2000-168612

(51) Int. Cl.[7] ..... H02K 11/00

(52) U.S. Cl. ..... 310/68 C; 310/71; 361/22; 361/104; 439/622

(58) Field of Search ..... 310/68 C, 71; 361/22, 103, 104; 439/620–622

(56) References Cited

U.S. PATENT DOCUMENTS 4,252,394 A * 2/1981 Miller ..... 174/152 GM
4,611,138 A * 9/1986 Kindig et al. ..... 310/157
4,748,531 A * 5/1988 Ortiz ..... 361/105
4,791,329 A 12/1988 Ubukata et al.
5,015,985 A 5/1991 Ubukata et al.
5,196,820 A * 3/1993 Ubukata et al. ..... 337/3
5,509,786 A * 4/1996 Mizutani et al. ..... 361/26
5,515,217 A * 5/1996 Higashikata et al. ..... 361/103
5,607,610 A * 3/1997 Furukawa ..... 219/488
5,615,071 A * 3/1997 Higashikata et al. ..... 361/103
5,903,418 A 5/1999 Boivin et al.
6,005,471 A * 12/1999 Higashikata et al. ..... 337/347
6,315,528 B1 * 11/2001 Williams et al. ..... 340/649

FOREIGN PATENT DOCUMENTS

JP 7-241061 9/1995

* cited by examiner

*Primary Examiner*—Joseph Waks
(74) *Attorney, Agent, or Firm*—Russell E. Baumann; Frederick J. Telecky

(57) ABSTRACT

A protective device (3) for a hermetic type electromotively driven compressor **(1*a*) includes a protector assembly (30) having a housing (32) with an electric current fuse (34) which detects a predetermined over-current. The housing (32) comprises an electrically insulating skirt member (31) formed so as to block a conductive part on the side facing an external connection terminal. By forming the electrically insulating skirt member (31) of housing (32) for a hermetic type electromotively driven compressor, insulation distance between a conductive part such as the electric current fuse (34) and an external conductive part such as a metal wall part (21)** is set to be 9.5 mm or more.

12 Claims, 15 Drawing Sheets

PROTECTIVE DEVICE FOR A HERMETICALLY SEALED TYPE COMPRESSOR AND A HERMETICALLY SEALED COMPRESSOR LISTING SAME

FIELD OF THE INVENTION

This invention relates generally to hermetically sealed, electromotively driven compressors for air conditioning and refrigeration applications and the like and more particularly to protective devices used with such compressors.

BACKGROUND OF THE INVENTION

Protective devices for de-energizing hermetically sealed, electromotively driven compressors which are mounted on a sealed terminal assembly inside the sealed casing of the compressors and which have a fuse function actuated by detecting an over-current generated by a faulty motor or the like are known.

FIG. 14 is a perspective view of the back side of a prior art protective device 101 for a hermetically sealed type electromotively driven compressor. Surface 103 of housing 102 of protective device 101 has holes 104 that correspond to electrically conductive pins of a sealed terminal assembly of the compressor casing (not shown in the drawing). The protective device has some electrically conductive parts that are exposed or openings which expose conductive parts. For example, the electrically conductive part of a protector 106 is exposed at opening 105 that was formed in connection with the forming of housing 102. In addition, electrically conductive parts such as a current fuse 107 and that part to which the fuse is welded are also exposed.

It is known to maintain an insulation distance for these exposed parts as stipulated in an official standard for electrically conductive parts of the sealed terminal or other conductive parts in a hermetically sealed casing.

However, if a large electric current, generated at the time of a fault condition of the electric motor, is detected and the current fuse is melted, an extremely large reverse electromotive force is generated at that moment. This reverse electromotive force generates an electric discharge phenomenon. If an electrically conductive part is exposed on surface 103 that faces the sealed terminal in the casing and unless a sufficient insulation distance is provided, the electric discharge phenomenon between the electric current fuse can jump to the sealed terminal or conductive parts in the sealed casing, thereby forming an electric circuit which could develop into such problems as a sealed terminal jump or earth leakage due to internal short circuiting.

In the conventional protective device for a hermetically sealed electromotively driven compressor, it has been difficult to avoid exposing the electrically conductive parts due to restrictions on the techniques used for the preparation of the electrically conductive parts or for the preparation of the protector assembly. The fuse function that is actuated by detecting a large electric current generated at the time of a fault of the electric motor is a comparatively new technology and using the standard for insulation distances based on the official specifications that presently exist does not adequately deal with this new technology. The development of sealed terminal jumps due to internal short circuiting or an earth leakage have been reported in the past despite the fact that these standards were observed.

Leakage of a coolant gas in a hermetically sealed electromotively driven compressor and equipment provided therewith is an example of an abnormal condition to which such compressors can be subjected and a room air conditioner is a representative device employing such a hermetically sealed electromotively driven compressor. In the case of the normal room air conditioner, the condenser is usually referred to as outdoor equipment and the evaporator as indoor equipment and these are arranged at a distance from each other. If there is some fault in the installation work of the equipment, a crevice or cracking could occur in the cooling system which should be air-tight, with a result that coolant gas starts leaking and air starts entering the system. Even in the case of a refrigerator and the like for which no piping installation work is required, such a crevice or cracking could develop if there is damage during the course of transportation or usage, or if there is a defect in manufacturing, with a similar result of coolant gas leakage, thereby allowing air to enter into the cooling system.

Coolant gas leakage is one of the major causes for burning of electric motors in such systems. In view of the fact that the coolant gas also serves to cool the motor by removing heat produced by the motor when the gas circulates inside the hermetically sealed electromotively driven compressor, a leak of the coolant gas brings about a rise in the temperature of the motor. When this happens, the temperature of the motor increases but the operating current decreases. Therefore, protection cannot be provided by a protector of the type that detects an over-current for shutting off the electric current. As a consequence, the electric motor is easily damaged. If the electric motor in a hermetically sealed electromotively driven compressor is damaged, the insulation film on the windings is destroyed, thereby developing short-circuiting which will, in turn, bring about the generation of an extremely large electric current. If such a large electric current is allowed to continue, the sealed terminal pins of the hermetically sealed electromotively driven compressor can be blown out of the terminal assembly or a fire can result due to over-heating by the electric current. In order to solve such a problem, protector devices have been provided with an electric current fuse for the purpose of shutting off such a large electric current. On the other hand, however, there are cases where the sealed terminal jump or earth leakage of the hermetically sealed type electromotive compressor occurs through the use of the electric current fuse. That is, as stated above, when the large electric current generated upon burning of the electric motor is shut off, an extremely large reverse electromotive force is generated in the motor.

A rough schematic of the electric circuit of the normal operation of equipment provided with a hermetically sealed electromotively driven compressor is shown in FIG. 15. As shown in the figure, an electric current fuse 118*d* is connected in series with the power source circuit of the electric motor having a main coil 118*a*, a start coil 118*b* and a capacitor 118*c*. Due to voltage from the power source, electric current flows driving the motor and the hermetically sealed compressor is operated normally and, in this state, electric current fuse 118*d* is not affected.

FIG. 16 is an electric circuit schematic at the moment when a fault develops in the equipment that is provided with a hermetically sealed electromotively driven compressor, causing a large electric current and actuation of the current fuse. In this state, fuse 118*d* is melted and the power source circuit is open as shown in the figure. At this instant, a reverse electromotive force 119*a* is generated in the direction of continued current flow in conformity with Lenz's law. This reverse electromotive force 119*a*, which is dependent upon the size of the motor and the kind of the electromotive system, sometimes reaches a range between approximately 6000 and 9000 volts because the electric current fuse cuts off the current in an extremely short period of time. This is clearly observed from the function of the electromagnetic induction:

Electromotive Force e=M(di/dt)

(M=mutual inductance, di=amount of a change in the electric current, and dt=changed time)

In the case of a commercial power source, one phase is usually grounded. Schematics of the electric circuit in equipment which is provided with a hermetically sealed electromotively driven compressor including its grounding is shown in FIGS. 17 and 18. In FIG. 17, the commercial power source is grounded at 120*a* on the side where the electrical current fuse 118*d* is connected. In addition, a dashed line indicates a sealed casing 120*b* grounded at 120*c*. In FIG. 18, the commercial power source is grounded at 121*a* on the opposite side of the electric current fuse 118*d*. Likewise, the dashed line indicates the sealed casing 121*b* grounded at 121*c*.

The state of the circuit at the instant fuse 118*d* melts due to an over-current generated as a result of a fault in equipment provided with a hermetically sealed electromotively driven compressor is shown in FIG. 19. Along with actuation of fuse 118*d*, the circuit opens and a reverse electromotive force 119*a* is generated in the motor as shown in the figure. If, when this happens, the insulation distance 122*a* between the metal part inside of sealed casing 120*a* or the metal part at the sealed terminal and the electrically conductive part of the protector assembly is merely the distance according to the official standard, it becomes impossible to withstand the reverse electromotive force that has been generated by the electric motor and the electric discharge will jump over. In view of the fact that the sealed casing 120*b* is ordinarily grounded at 120*c*, the electric current due to the electric discharge ends up flowing to the power source through the grounding. This state is shown in FIG. 20. The reverse electromotive force 123*a* generates an electric current and this electric current flows through the normal circuit 123*b* and jumps over to the sealed casing 120*b* from that part where the insulation distance is deficient generally in the neighborhood of the electric current fuse 118*d*, with a result that an electric discharge 123*c* takes place. In other words, electric current 123*d* that has flowed in sealed casing 120*b* flows into ground 123*e* through grounding 120*c* and enters grounding 120*a* of the commercial power source from the ground as shown at 123*f*, thereby forming a complete electric circuit. Once the electric circuit is formed by an electric discharge, the ambient atmosphere is ionized, with the electric discharge being continued even with the low voltage of the commercial power source in some cases. As a consequence of this, continuous electric conductance takes place with the power source voltage along such a route as shown in FIG. 21.

In addition to the above, when a leakage of the coolant gas takes place, air enters from outside and the pressure inside the hermetically sealed type electromotively driven compressor becomes approximately equal to the atmospheric pressure. As a result, the insulation resistance suddenly decreases, thereby making it even easier for the above described electric discharge phenomenon to take place. According to Pachen's rule as described in Electricity and Magnetism in 1.1.11 in Chapter 1, dealing with electricity, in the Revised Edition Six of Mechanical Engineering Handbook, Third Print, Sixth Edition, revised on Mar. 20, 1982 by the Society of Machinery of Japan, for example, the minimum voltage for the development of an electric discharge between a plane electrode and an edge electrode in ordinary air is 1000 volts for one millimeter of insulation distance.

Official standards such as IEC Standard 60730-2-4 stipulate that the spatial distance relative to the motor protector inside compressors whose ratings are less than two kw and less than 300V is to be greater than 1.6 mm. Along this line of thinking, it can be stated that the insulation pressure resistance at a time when a leakage of the coolant gas occurs and air starts coming in decreases to the vicinity of 1600V.

1000 (V/mm)×1.6 (mm)=1600V

The insulation distance as stipulated by such an official standard cannot be termed sufficient as applied to such an abnormal situation as when an electric current fuse is actuated.

SUMMARY OF THE INVENTION

It is an object of the present invention to provide a solution to the above noted problems of conventional technology. Another object of the invention is the provision of a protective device for use with hermetic type electromotively driven compressors without causing pin blow out or earth leakage even when a fuse is blown out by huge currents generated in abnormal situations such as a gas leak.

A protective device made in accordance with the invention is particularly adapted for use with a hermetically sealed type electromotively driven compressor. The protector device has a current fuse that actuates upon detecting a predetermined over-current provided therein and is provided with an insulation member so that the insulation distance of any electrically conductive part in the protective device, including the fuse, has a value which is greater than a predetermined value of 9.5 mm or greater as measured along the surface. By maintaining an insulation distance at 9.5 mm or greater, an insulation pressure resistance of 9500 V can be achieved according to the following equation:

1000 (V/mm)×9.5 (mm)=9500V

Even in the event of coolant gas leakage, with a consequential leakage of air into the cooling system and a resultant lowering of the insulation pressure resistance, therefore, it becomes possible through the invention to secure adequate insulation pressure resistance against the high voltage that is generated when the electric current fuse is actuated.

According to a feature of the invention, the insulation member is formed in such a way as to cover or block electrically conductive parts on that side of the protective device which faces the external connection terminal assembly in the casing of the compressor.

According to another feature of the invention, the said insulation member also serves as a locking member for locking the lead wire for connective purposes thereby reducing the dimension in the height direction of the housing of the protector device. This is all the more economical as there is no need to increase the number of the parts involved.

According to yet another feature, the said insulation member includes a protruding portion that sticks out from the side of the housing of the protective device, thereby providing sufficient insulation distance and enabling a reduction of the height direction dimension of the housing, making it possible to obtain a stronger electric insulation member. According to a feature of the invention, the housing of the protective device is made of a resin material and said protuberant piece is integrally formed with said housing, thereby making it possible to reduce the number of parts and assembling steps required and, at the same time, making it possible to select the insulation material according to the particular requirements involved.

BRIEF DESCRIPTION OF THE DRAWINGS

Other objects, advantages and details of the novel and improved protective device for hermetically sealed compressors and a hermetically sealed compressor using the device of the invention appear in the following detailed description of preferred embodiments of the invention, the detailed description referring to the drawings in which:

FIG. 4(*b*) is a cross section taken along line A—A in FIG. 4(*a*);

DETAILED DESCRIPTION OF PREFERRED EMBODIMENTS

Figure 1:
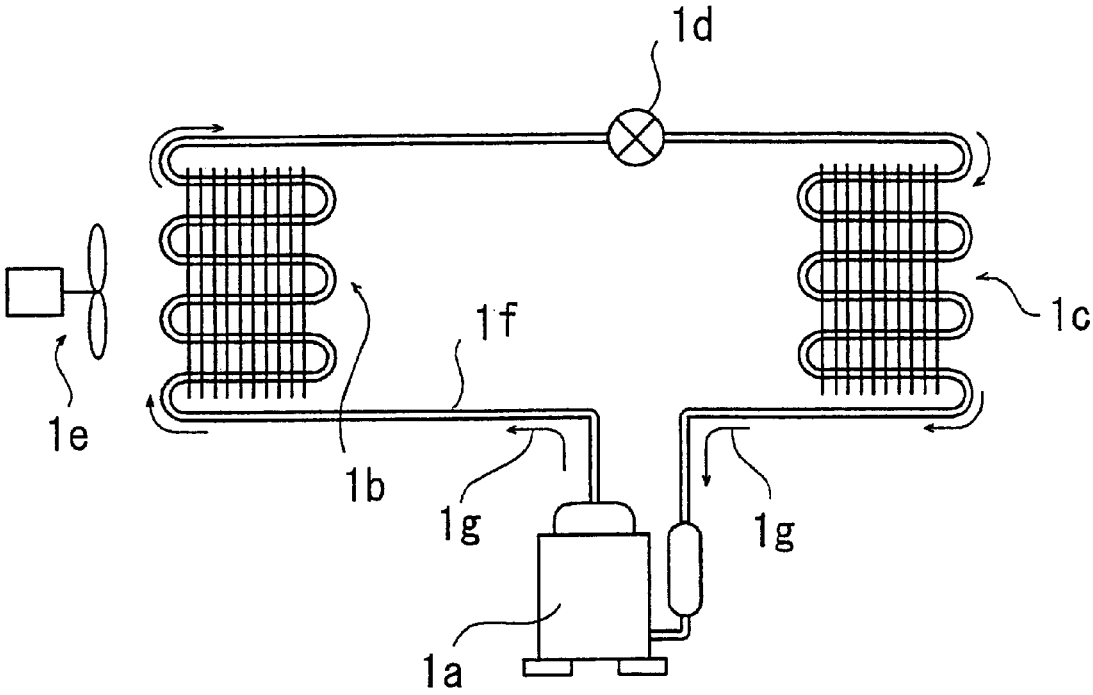
FIG. 1 is a schematic illustration of a cooling system using a hermetically sealed type electromotively driven compressor having a protective device made according to the invention.

As shown in FIG. 1, the hermetically sealed type electromotively driven compressor 1*a* of this embodiment is connected to a condenser 1*b* and an evaporator 1*c* by means of piping 1*f*, thereby comprising a single hermetically sealed cooling system. As shown, the flow of the coolant in the cooling system is indicated by an arrow 1*g*. The coolant that has been compressed inside the hermetically sealed type electromotively driven compressor 1*a* flows inside piping 1*f* in the direction indicated by arrow 1*g* and, after being cooled by a cooling fan 1*e* arranged inside condenser 1*b*, the coolant passes an expansion mechanism 1*d* and is evaporated in the evaporator 1*c*, thereby absorbing heat for cooling purposes.

Currently, R22, R410a, and the like are employed as said coolants. In due consideration of problems relating to the destruction of the natural environment, however, natural system coolant (which is called HC coolant) is currently being examined. Propane gas and isobutane gas are among those gases under consideration. Since these gases are combustible, there is a need to prevent the possibility of a fire which could occur should air enter into the hermetically sealed housing. This invention solves this problem as well.

Figure 2:
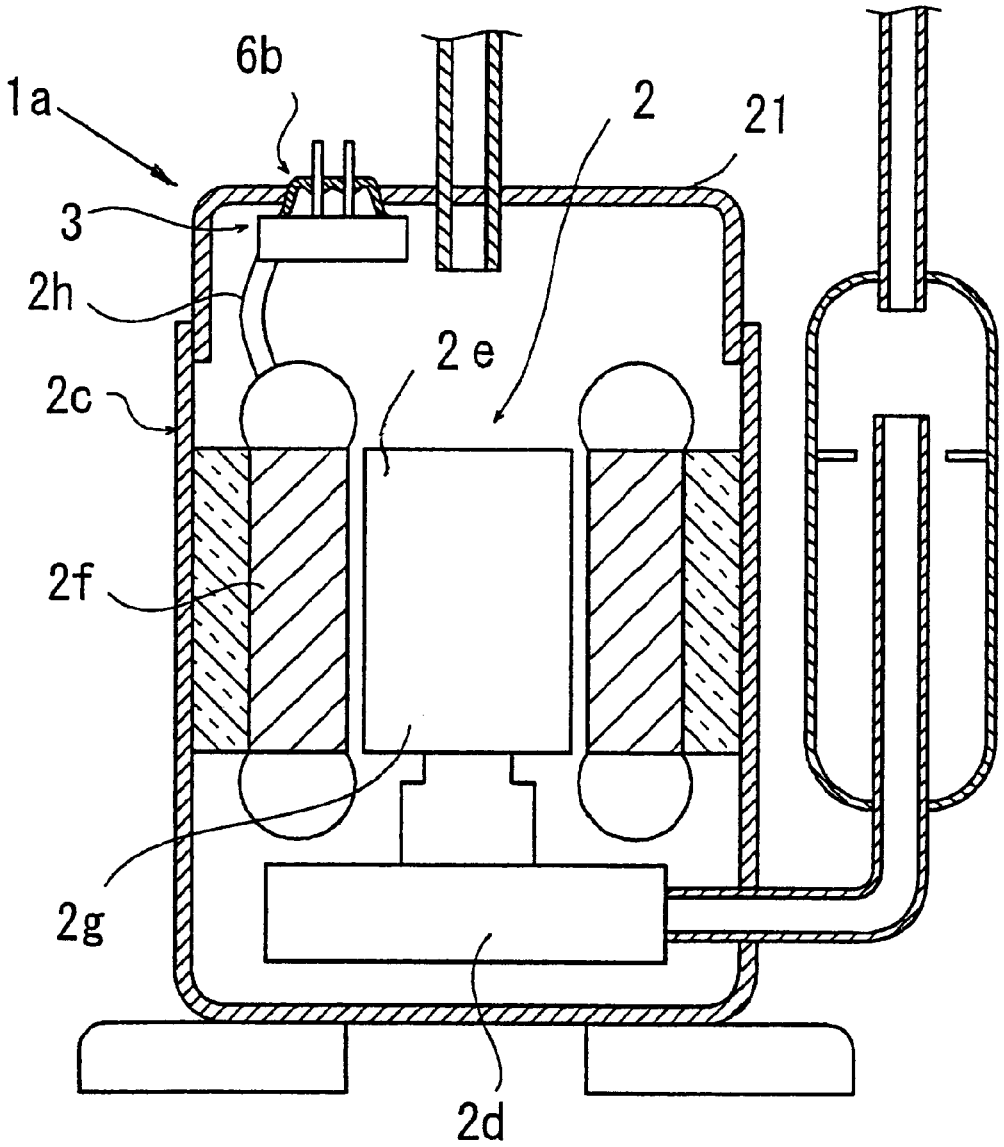
FIG. 2 is a cross section showing the interior construction of a hermetically sealed electromotively driven compressor having a protective device made according to the invention.

As shown in FIG. 2, the hermetically sealed type electromotively driven compressor 1*a* of this embodiment has a tightly sealed casing 2*c*. An electric motor 2 comprising a coil 2*e*, a fixed element 2*f* and a rotor 2*g*, and a compressor 2*d* are accommodated in casing 2*c*, with the compressor 2*d* being driven by motor 2.

A sealed terminal assembly 6*b* is installed on metal wall 21 at the top of the sealed casing 2*c*. A protective device made in accordance with the invention for a hermetically sealed type electromotively driven compressor is mounted within the sealed casing at the terminal assembly. As shown in FIG. 2, the protective device 3 for the compressor has a protector assembly 30 which will be described below. This protector assembly 30 is connected to the motor coil of the hermetically sealed type electromotive compressor 1*a* through such connective lead wires 2*h* as the common, the main and the start.

Figure 3:
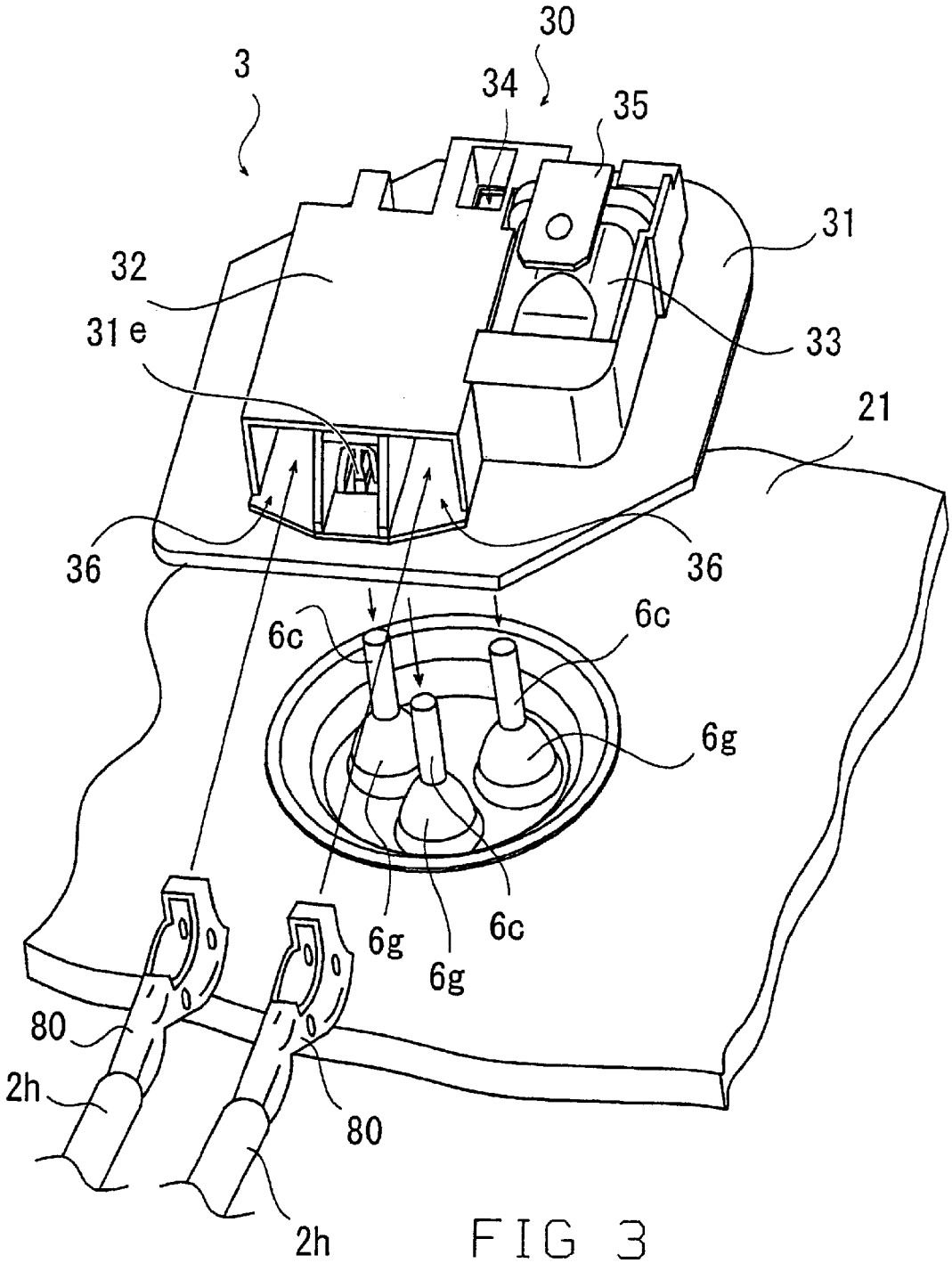
FIG. 3 is a perspective view showing the entire arrangement of a protective device for a hermetically sealed type electromotively driven compressor in the form of a preferred embodiment and showing a broken away portion of the compressor housing.

FIG. 3 is a perspective view of a protective device for a hermetically sealed type electromotive compressor according to a preferred embodiment, showing its entire construction. The view is inverted relative to FIG. 2. It is mentioned in this connection that although the protector assembly 30 of the protective device 3 for a hermetically sealed type electromotively driven compressor is to be used installed on the sealed terminal assembly 6*b* of the hermetically sealed type electromotively driven compressor 1*a*, they are separated from each other in the figure for the purpose of facilitating the description.

As shown in FIG. 3, protector assembly 30 of protective device 3 has a protector 33, an electrically conductive terminal connector pin (not shown in FIG. 3), an electric current fuse 34 electrically connected in series with protector 33 (see FIG. 7) and an electrically conductive common connection terminal 35, etc., all incorporated into housing 32 which is preferably made of resin material. Protector 33, as is known in the art, contains a temperature sensitive bimetal switch member to open the circuit to protect the compressor motor against over temperature/current conditions along with fuse member 34 which very quickly reacts by melting in large electric current overloads. An electric insulation skirt member 31, made of suitable insulation material such as resin, to cite an example, is disposed on protector assembly 30 on the side of the sealed terminal assembly 6*b*. In accordance with this embodiment, the electric insulation skirt member 31 is formed separately from housing 32 and also serves a role of a lead wire locking member for locking lead wire 2*h*. As will be explained below, skirt member 31 is engaged with housing 32 by means of an engagement part 31*e* which is provided on skirt member 31. Skirt member 31 is formed so that all of the surface that is facing the sealed terminal assembly 6*b* of the housing may be covered.

The common wire of lead wire 2*h* of said electric motor 2 is connected to the electrically conductive common connective terminal 35 of protector assembly 30. Meanwhile, the main and start wires of lead wire 2*h* are inserted into the respectively preselected slots 36 and fixed by means of a lead wire locking member. This locking function will be separately explained in connection with FIG. 8. In addition, the main and start lead wires are designed to be connected to respective electrically conductive pins 6*c* of the sealed terminal assembly 6*b*.

Figure 4A:
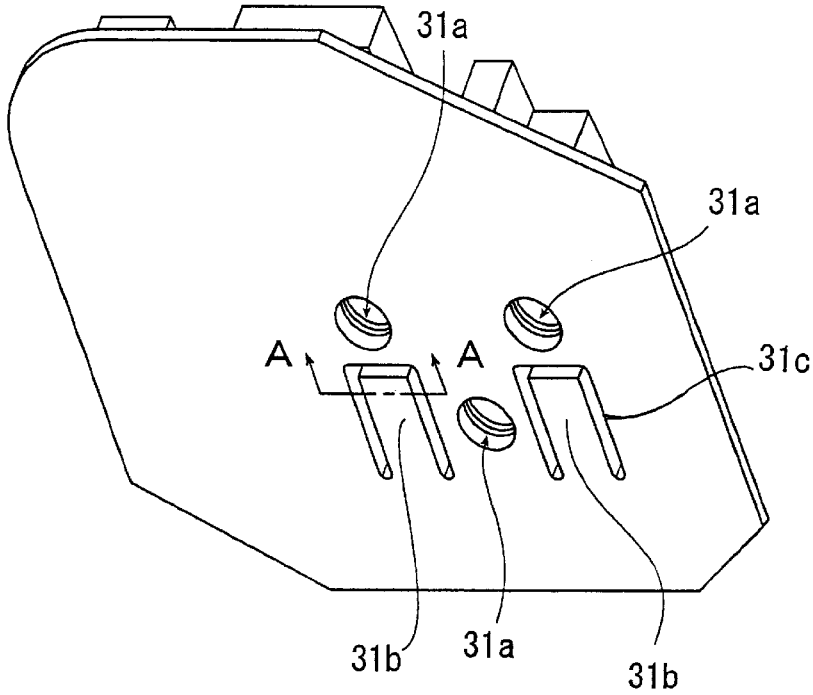
FIG. 4(*a*) is a perspective view of the reverse side of the FIG. 3 protective device.
Figure 4B:
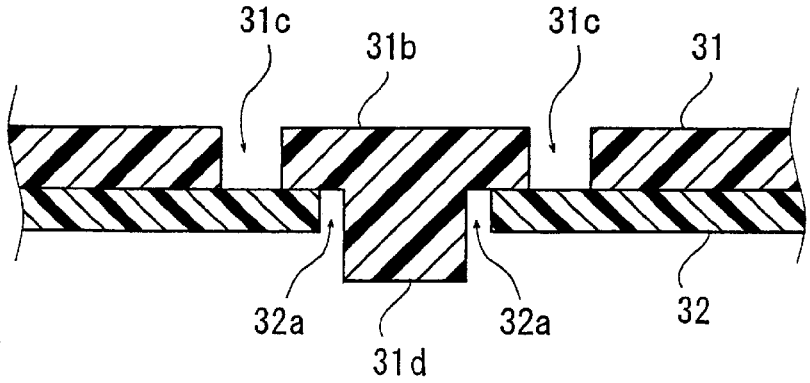
Figure 5:
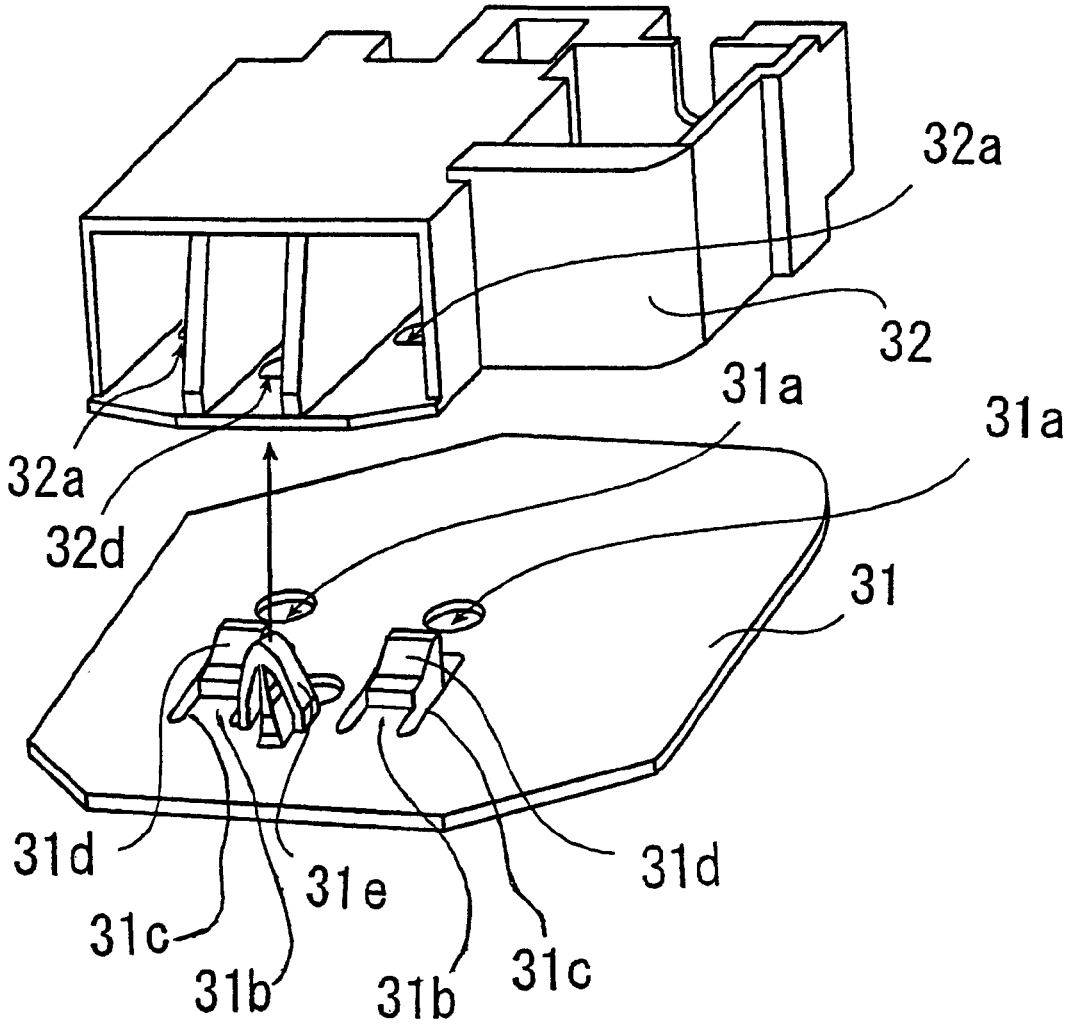
FIG. 5 is a perspective view of the FIG. 3 protective device, as dismantled.

As shown in FIG. 4(*a*), a hole 31*a* that corresponds to each conductive pin of the sealed terminal assembly 6*b* is provided in electric insulation skirt member 31. As a conductive pin 6*c* of the sealed terminal assembly 6*b* and a respective conductive pin terminal connector 6*d* (FIG. 6) are connected with each other through respective holes 31*a*, the protector assembly 30 is installed on the sealed terminal assembly 6*b*. In this embodiment, the opening of housing 32 and the exposed electrically conductive part (not shown in the drawing) which are located on the surface that is facing sealed terminal assembly 6*b* are covered by the electric insulation skirt member 31 and, as will be described below, a sufficient insulation distance is secured from the metal wall 21 of the sealed casing 2*c*. The electric insulation skirt member 31 in this embodiment also serves the role of a lead wire locking member for locking lead wires and a pair of cantilever beam parts 31 formed approximately at the center of the skirt member 31 perform this function. In this embodiment, the cantilever beam part 31*b* is provided by forming a U-shaped slot 31*c* in skirt member 31 as shown in FIGS. 4(*a*) and 4(*b*). A wedge-shaped part 31*d* is formed on cantilever beam part 31*b* as shown in FIGS. 4(*b*) and 5 and this wedge-shaped part 31*d* is so designed as to enter the opening that has been formed at the bottom of housing 32. Moreover, slot 31*c* in skirt member 31 is covered by the bottom of housing 32 so that the electrically conductive part will not be exposed. A latch-shaped engagement part 31*e* is provided on skirt member 31 and, as engagement part 31*e* is inserted into latch receiving opening 32*d* of housing 32, skirt member 31 is attached to housing 32.

Figure 6:
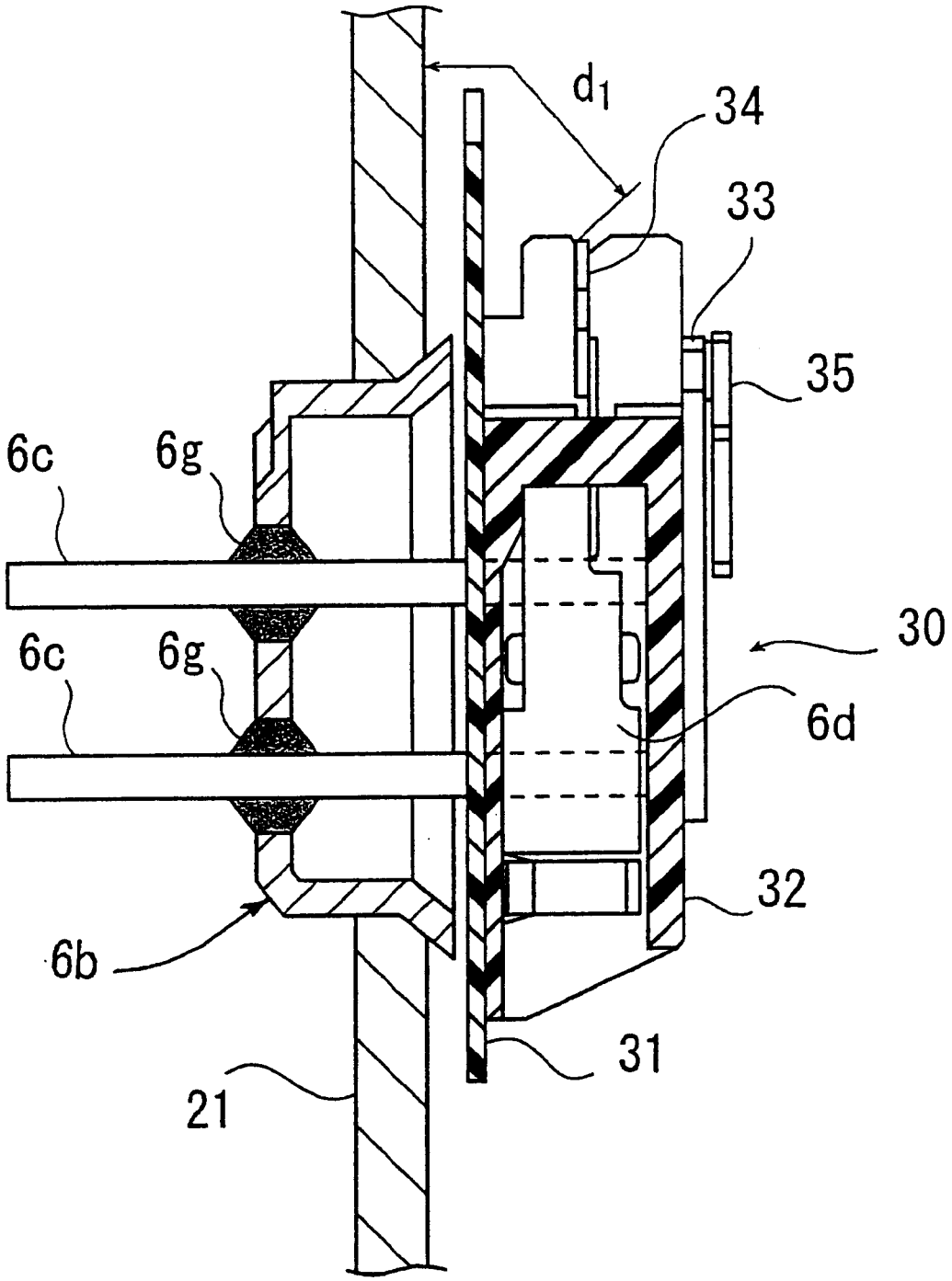
FIG. 6 is a cross section showing the FIG. 3 protective device installed on a sealed terminal assembly.

As shown in FIG. 6, sealed terminal assembly 6*b* is fixed to the metal wall 21 of the sealed casing with three electrically conductive pins 6*c* provided (two being shown), which are held and sealed by insulators 6*g*. A protector assembly 30 comprising the above described conductive pin terminal connector 6*d*, housing 32, electric current fuse 34, conductive common connective terminal 35 and protector 33, etc., is installed on the electrically conductive pins 6*c* of the sealed terminal assembly 6*b*.

According to conventional technology, the electric current fuse 34 is exposed to the metal wall 21 of the sealed casing and the insulation distance is approximately seven mm which is not sufficient for the high voltage that is generated upon the sudden melting of the electric current fuse. In this embodiment, on the other hand, the electric insulation skirt member 31 is provided in order to prevent electric current fuse 34 from being exposed to the metal wall 21 of the sealed casing 2*c*. In addition, the insulation distance d1 of electric current fuse 34, a conductive part, shown in FIG. 6, from the metal wall 21 is 9.5 mm or greater. In other words, the electrical insulation skirt member 31 is provided so that this insulation distance d1 is set at a dimension sufficient to secure at least 9.5 mm.

Figure 7:
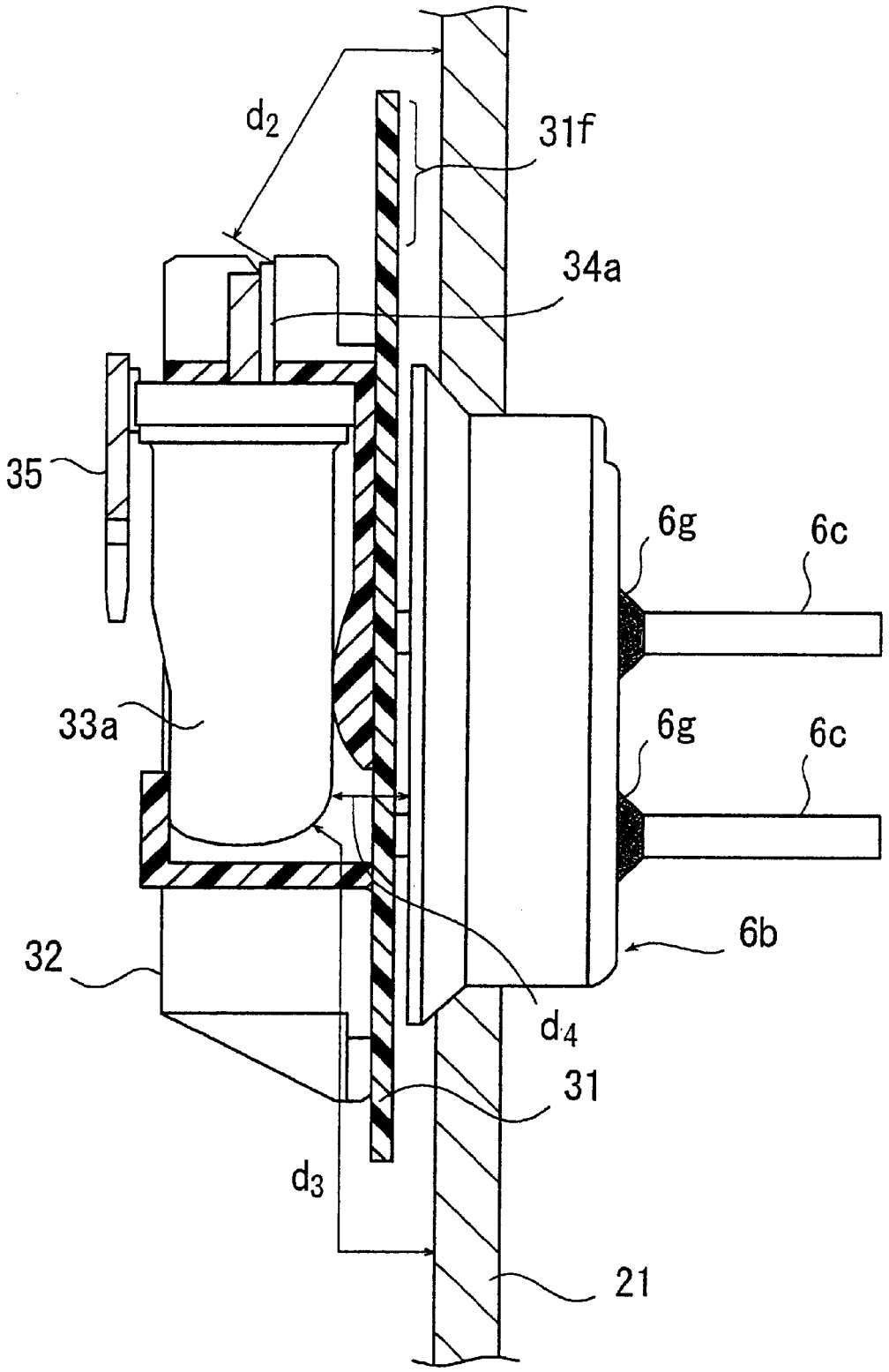
FIG. 7 is another cross section, slightly larger scale and taken from an opposite direction relative to FIG. 6, installed on a sealed terminal assembly.

In the protective device 3 for the hermetically sealed electromotively driven compressor, it is necessary to maintain sufficient insulation distance from all conductive parts. If the electric insulation skirt member 31 in this embodiment is employed, however, it becomes possible to cover the various electrically conductive parts and sufficiently secure the insulation distance d by properly setting the size of the electrical insulation skirt member 31 (part shown by 31*f*). In this embodiment as shown in FIG. 7, the welded part 34*a* of the electric fuse and the casing 33*a* of the protector 33 are covered (d2, d3 and d4).

Figure 8:
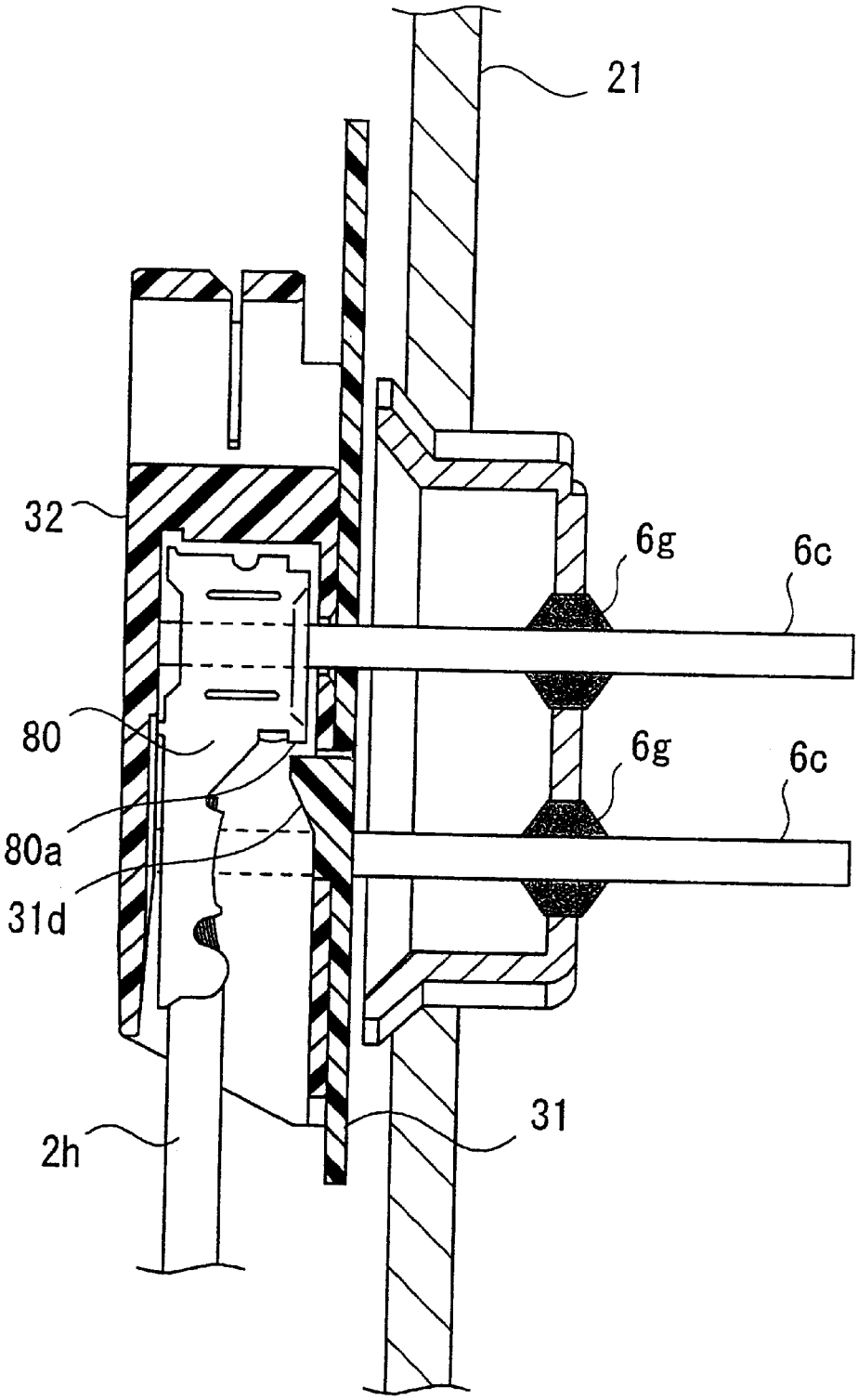
FIG. 8 is a cross section showing the protective device of FIG. 3 shown with an installed motor lead wire.

FIG. 8 is a cross section showing the protective device for a hermetically sealed type electromotively driven compressor in the state where a motor lead wire has been mounted. In this embodiment, the electrical insulation skirt member 31 also serves the role of a lead wire locking member as has been described earlier and a wedge-shaped part 31 d is provided on the inner side of the cantilever beam 31*b* which is shown in FIGS. 4(*a*), 4(*b*). When the connective terminal 80 that has been installed at the tip of the main and start wires 2*h* from motor 2 is inserted into respective slots 36 of lead guideways of housing 32, the cantilever beam 31*b* bends due to the effect of the inclined surface of the wedge-shaped part 31*d*. As a result, the connective terminal 80 for the main and start wires 2*h* can be inserted. When the connective terminal 80 comes to a predetermined longitudinal location in its respective guideway, the position of the cantilever beam 31*b* is restored and, as shown in FIG. 8, the possible withdrawal of the main and start wires 2*h* is prevented as the jaw part 80*a* of the connective terminal 80 is engaged with the vertical locking surface of wedge-shaped part 31*d*.

According to this embodiment described above, it becomes possible to sufficiently secure the insulation distance of the conductive part and, at the same time, cut down the cost of the product without increasing the number of parts involved. In view of the fact that opening 32*a* in housing 32 into which the wedge-shaped part 31*d* enters is blocked by the cantilever beam 31*b* as described above, the electrically conductive part is not exposed.

Figure 9:
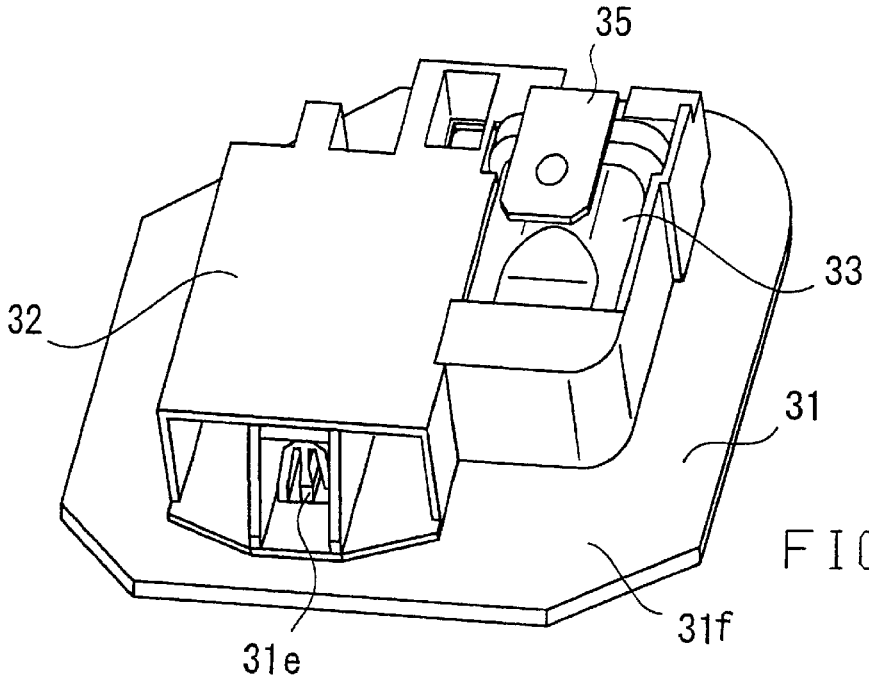
FIG. 9 is a perspective view showing the entire construction of a protective device for a hermetically sealed type electromotively driven compressor according to another embodiment of the invention.
Figure 10:
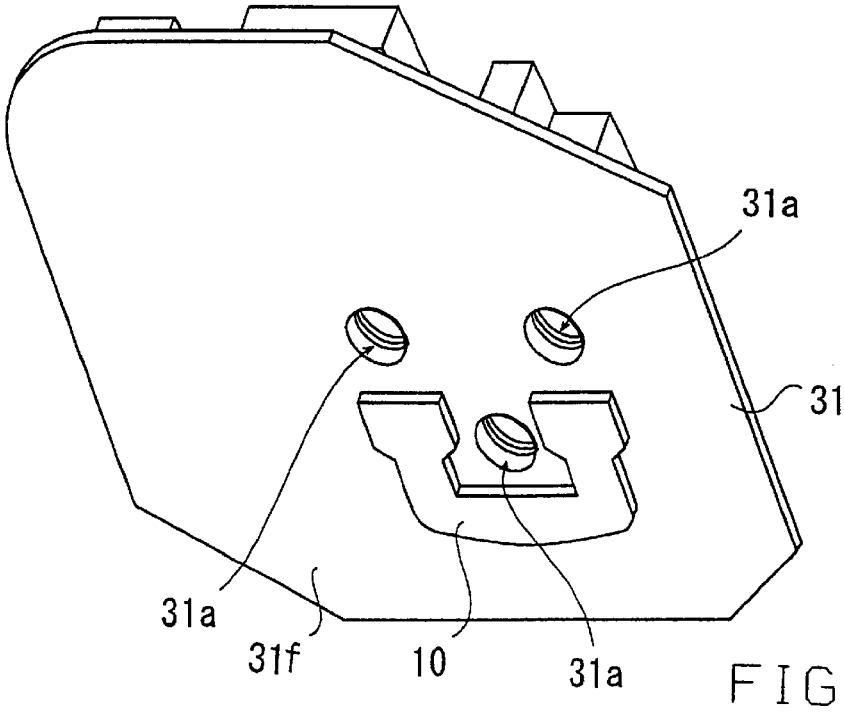
FIG. 10 is a perspective view of the reverse side of the FIG. 9 protective device.

FIG. 9 is a perspective view showing a complete protective device for the hermetically sealed type electromotively driven compressor according to another embodiment of the invention and FIG. 10 is a perspective view of the reverse side thereof. According to this embodiment, a protuberant skirt member 31*f* is placed at the bottom of housing 32 in such a way as to stick out of the side of housing 32 thereby providing sufficient insulation distance. Protuberant piece 31*f* may be formed separately from and installed on housing 32 or it may be formed integrally therewith.

In the embodiment shown in FIG. 8, the electrical insulation skirt member 31 serves the role of a lead wire locking member. In this embodiment, however, an exclusive lead wire locking member 10 is used. As shown in FIG. 10, a latch-shaped engagement part which is not shown in the figure is provided in the lead wire fixing member 10 and, as this engagement part is engaged with the housing 32, the lead wire fixing member 10 is fixed to the housing 32.

Moreover, the wedge-shaped part 31*d* for fixing the main and start wires 2*h* is accommodated in the opening (not shown in figure) which is provided on housing 32. However, this opening part is covered by the lead wire fixing member 10 as in the case of the embodiment shown in FIG. 8.

Figure 11:
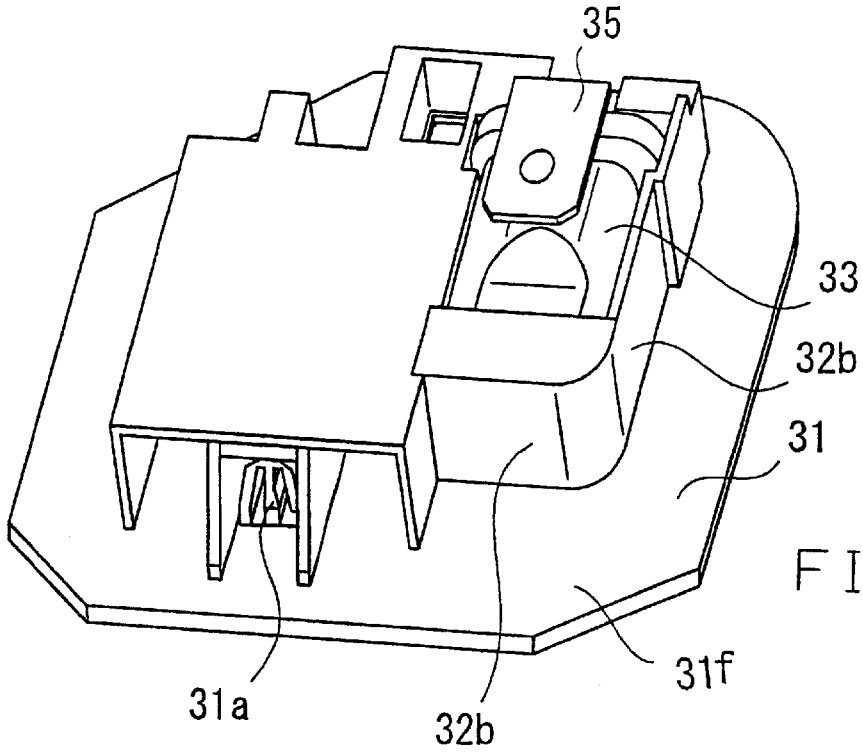
FIG. 11 is a perspective view showing the entire construction of a protective device for a hermetically sealed type electromotively driven compressor according to still another embodiment of the invention.
Figure 12:
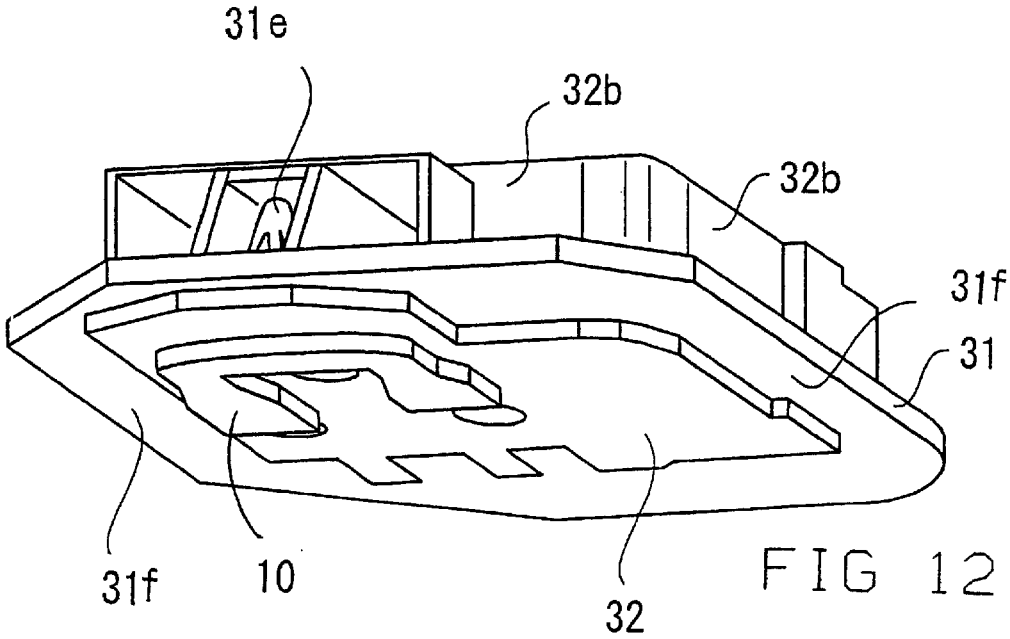
FIG. 12 is a perspective view of the reverse side of the FIG. 11 protector.

FIG. 11 is a perspective view showing the entire construction of the protective device for a hermetically sealed type electromotively driven compressor in still another embodiment of the invention and FIG. 12 is a perspective view of the reverse side thereof. In this embodiment, a protuberant skirt member 31*f* projects from the side of housing 32 on sides 32*b* of housing 32 and said insulation distance is sufficiently secured by means of this protuberant skirt member 31*f*. Protuberant skirt member 31*f* may be formed separately from the housing 32 or it may be formed integrally therewith.

In the embodiment shown in FIG. 8, the electrical insulation skirt member 31 serves the role of a lead wire locking member. In this example, an exclusive lead wire fixing member 10 is employed. As shown in FIG. 12, a latch-shaped engagement part which is not shown in the figure is provided on the lead wire locking member 10 and, as this engagement part is engaged with housing 32, the lead wire member 10 is fixed to the housing 32.

In the case of this embodiment, the wedge-shaped part 31*d* for locking the start wire 2*h* is accommodated in an opening (not shown in the drawing) that has been provided in housing 32. This opening part is covered by the lead wire locking member as in the embodiment shown in FIG. 8.

In the embodiments described above, an electrical insulation skirt member 31 is provided in the protector assembly 30 and the insulation distance between electrically conductive parts and the metal wall 21 of the sealed casing 2*c* is set at more than 9.5 mm. Even in the event where the hermetically sealed type electromotively driven compressor 1*a* is subjected to an abnormal state such as a gas leak, etc., with a resultant development of a large electric current and the sudden melting of the fuse, there will be no pin blow out or earth leakage, etc.

Figure 13:
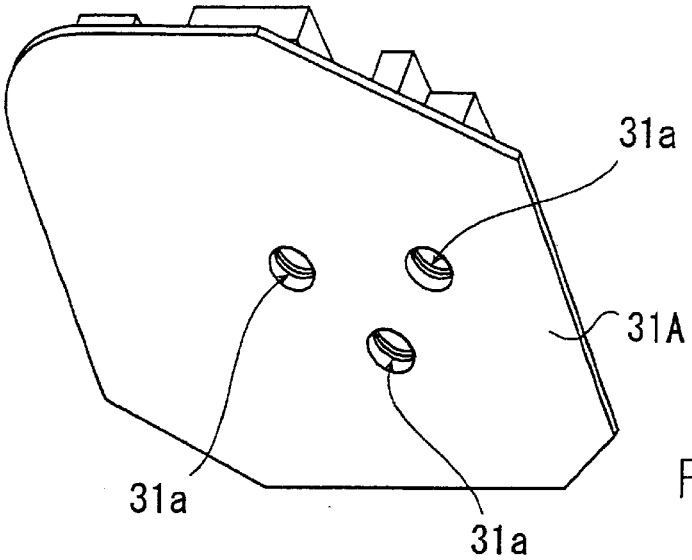
FIG. 13 is a perspective view of the reverse side showing another embodiment of a protective device for a hermetically sealed type electromotively driven compressor of the invention.
Figure 14:
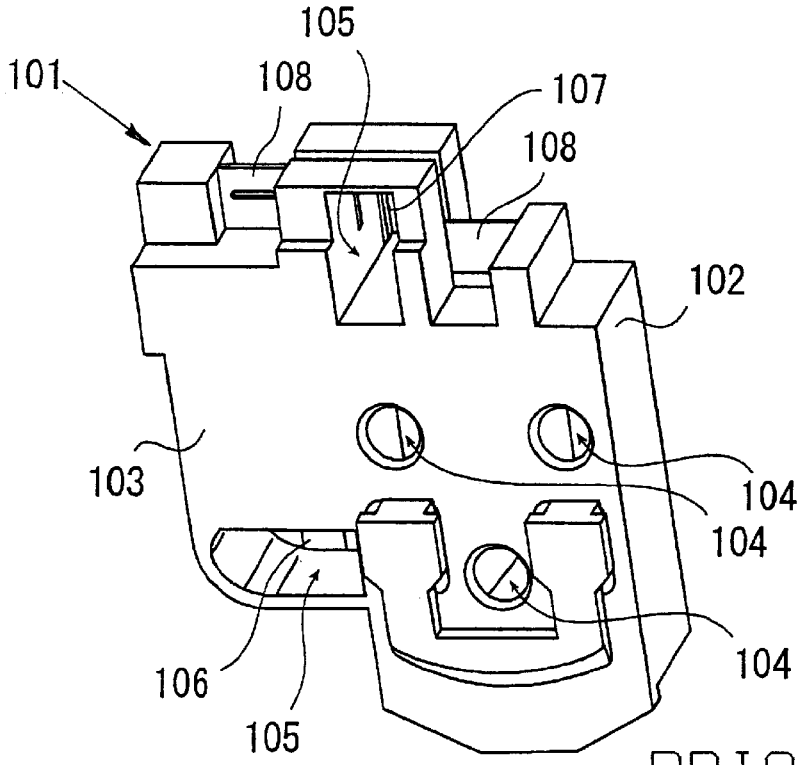
PRIOR ART FIG 14
FIG. 14 is a perspective view of the reverse side of a protective device for a hermetically sealed type electromotively driven compressor according to the prior art.
Figure 15:
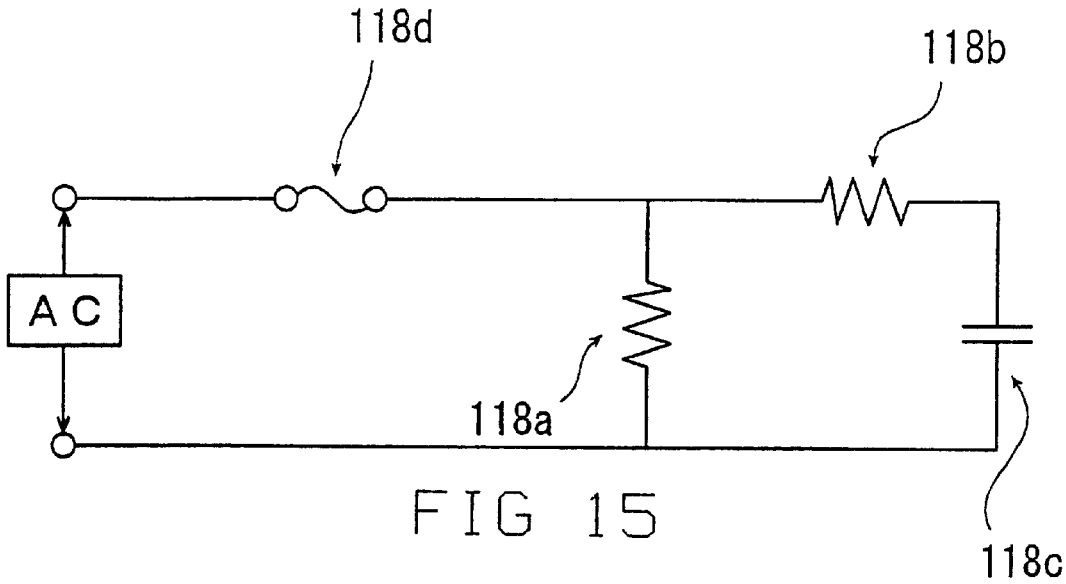
FIG. 15 is a schematic of an electrical circuit during ordinary operation of equipment which is provided with a hermetically sealed type electromotively driven compressor.
Figure 16:
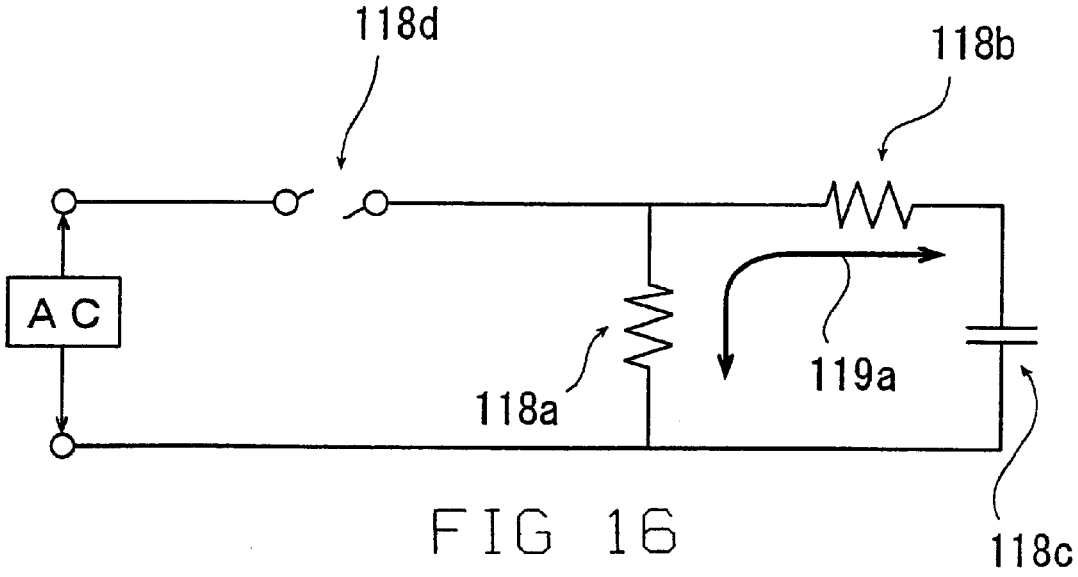
FIG. 16 is a schematic of the FIG. 15 electrical circuit at the moment when trouble has developed and a large electric current has started flowing in equipment which is provided with a hermetically sealed type electromotively driven compressor, with the resultant actuation of the electric current fuse.
Figure 17:
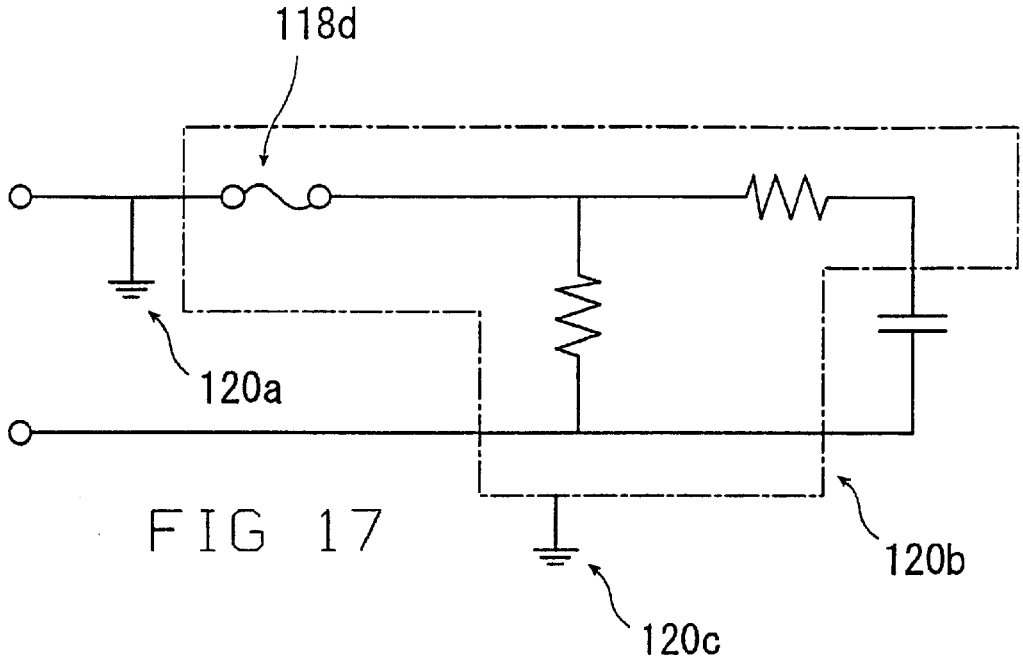
FIG. 17 is a schematic of an electrical circuit for a hermetically sealed type electromotively driven compressor showing one grounding arrangement.
Figure 18:
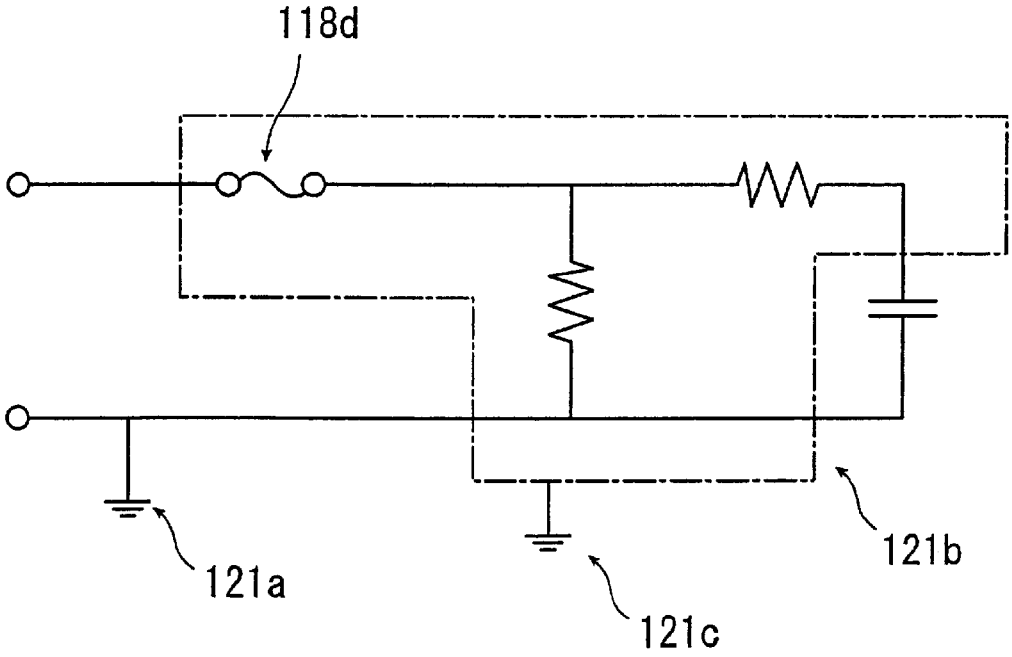
FIG. 18 is a schematic of an electrical circuit for a hermetically sealed type electromotively driven compressor showing another grounding arrangement.
Figure 19:
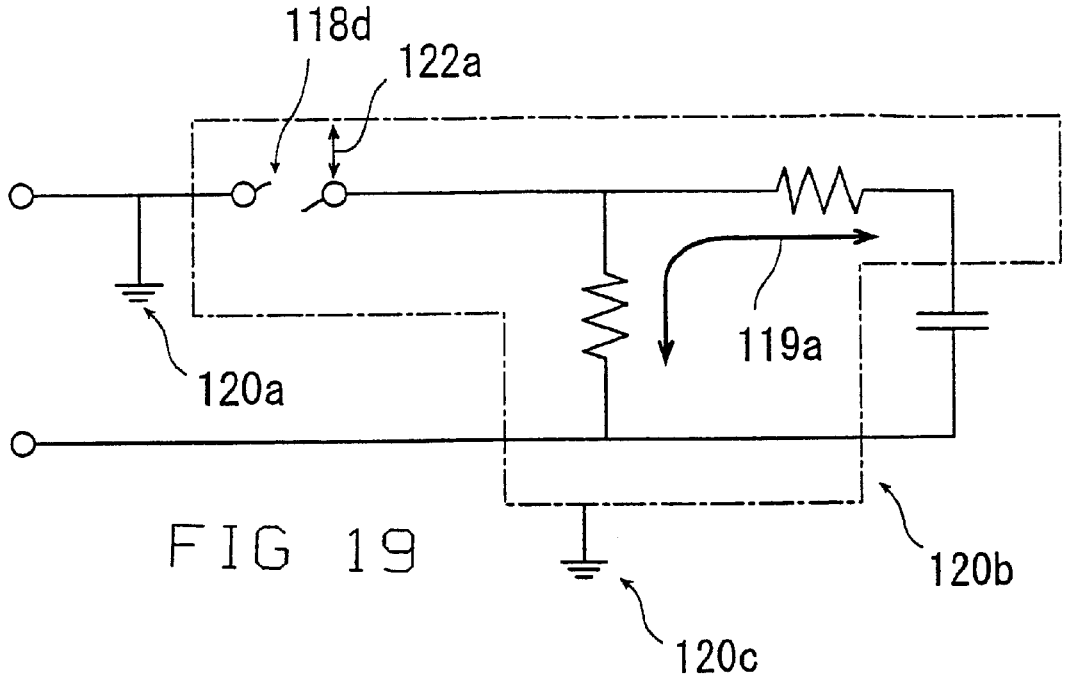
FIG. 19 is a schematic of the FIG. 17 electrical circuit at the moment when some trouble has developed in the equipment that is provided with a hermetically sealed type electromotively driven compressor, with the resultant development of a large electric current and actuation of the electric current fuse.
Figure 20:
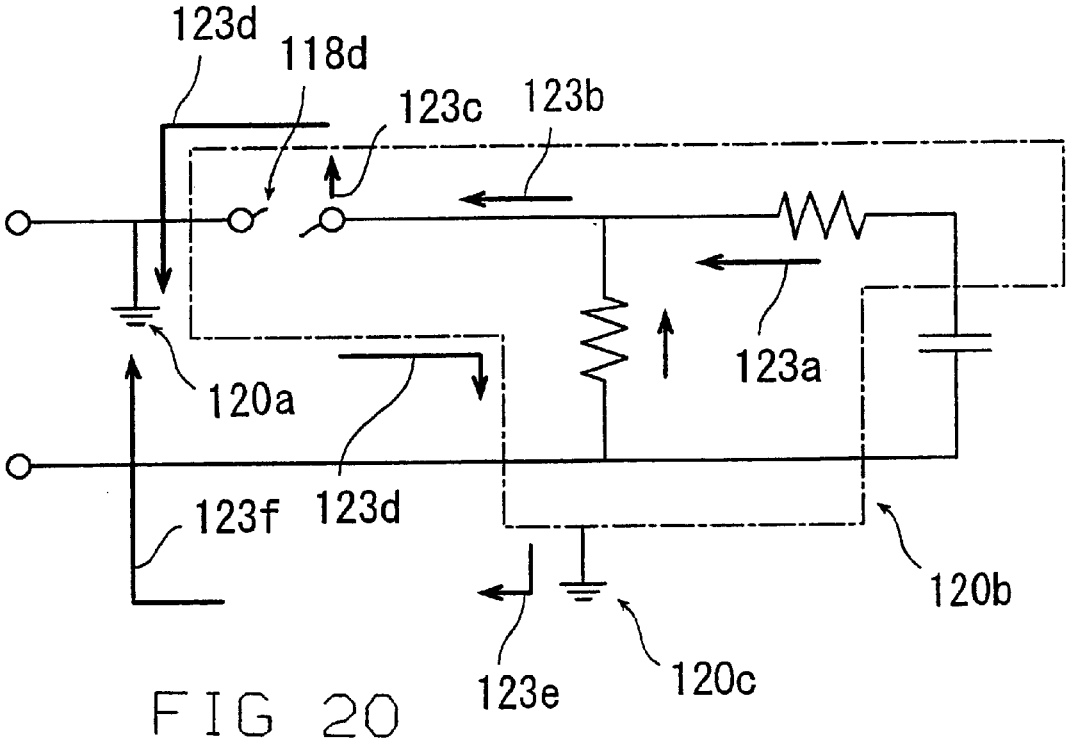
FIG. 20 is a schematic of the FIG. 17 electrical circuit at the instant when electric current due to an electric discharge has flowed to earth.
Figure 21:
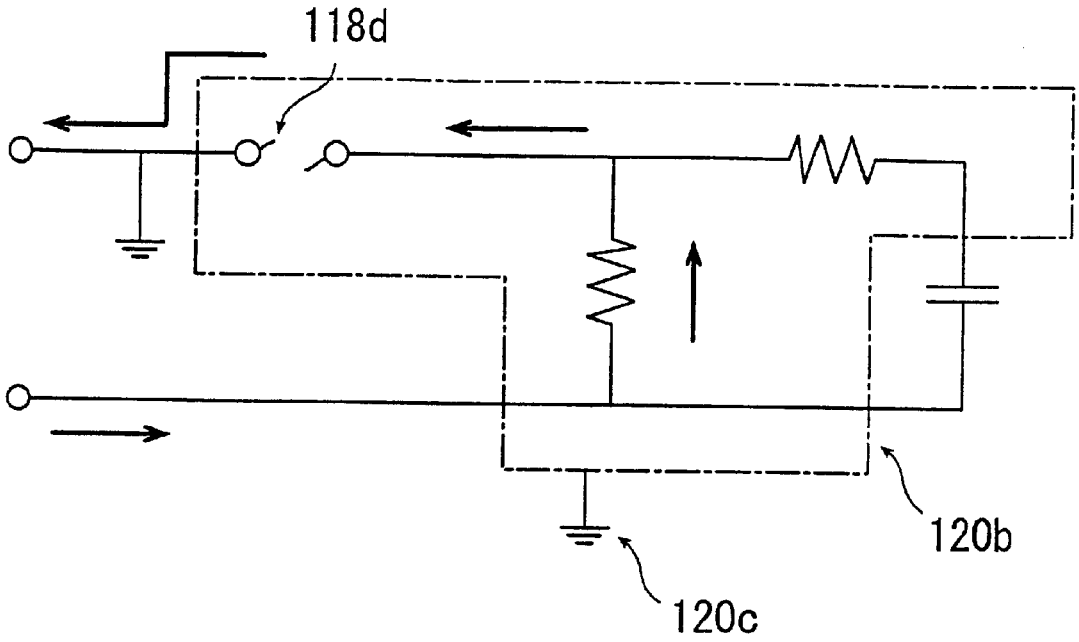
FIG. 21 is a schematic of the FIG. 17 electrical circuit at a time of a continuous electric conductance due to the source voltage as the result of a flow of electric current to earth.

FIG. 13 is a perspective view of the reverse side showing another embodiment of the protective device according to the invention. As shown in FIG. 13, there is absolutely no opening other than the openings 31 a in the electrical insulation skirt member 31A that corresponds to the electrically conductive pins 6*c*. In this case, a wedge-shaped part which is not shown in the drawing is formed on the surface of the electrical insulation skirt member 31A on the side of housing 32 and this wedge-shaped part is designed to enter the opening part that is formed on the bottom of housing 32. The remaining construction and functional effect are the same as in the form of the above described embodiment. Therefore, their detailed explanation will not be repeated here.

It will be understood that this invention can be modified in various ways without being restricted by the forms of the aforementioned embodiments.

It will be understood that it is possible to secure the insulation distance of 9.5 mm or greater as the spatial distance along the surface without using the electrical insulation skirt member 31. It is conceivable, for instance, to install the entire protector assembly away from the sealed terminal or reduce the thickness of the protector assembly itself to obtain an extra distance from the sealed terminal assembly. It is also possible to cover the exposure of electrically conductive parts with sealing material, etc.

In connection with the above explanations, the following will be further disclosed:

(1) a hermetically sealed electromotively driven compressor and equipment used therewith, comprising an electric motor that is accommodated in a sealed casing, a compressor which is accommodated in said sealed casing and driven by said motor, a sealed terminal assembly which is provided in said sealed casing, the terminal assembly including electrically conductive pins held and sealed by an insulator with the pins protruding both in and out of the said sealed casing, a protector assembly mounted on the said sealed terminal assembly inside the said sealed casing and a protector protecting said electric motor mounted in the protector assembly, the protector assembly having a fuse for detecting the large electric current that is generated at the time of some fault in said electric motor, characterized in that the electrically conductive parts are not exposed on the surface of said protector assembly that face said sealed terminal assembly and a sufficient insulation distance is secured between the electrically conductive parts of said sealed casing or other electrically conductive parts in said sealed casing and the electrically conductive parts of said protector assembly.

(2) A hermetically sealed type electromotively driven compressor and equipment that is provided with a hermetically sealed type electromotively driven compressor, characterized in that, in the immediately preceding Paragraph No. (1), the term "sufficient insulation distance" means a spatial distance of 9.5 mm or more as measured along the surface.

(3) A hermetically sealed type electromotively driven compressor and equipment that is provided with a hermetically sealed type electromotively driven compressor, characterized in that, in the preceding Paragraph No. (1), a lead wire locking member is utilized for the purpose of making it possible for the electrically conductive part of said protector assembly not to be exposed on the surface that faces said sealed terminal assembly and a sufficient insulation distance is secured between the electrically conductive part and the electrically conductive part of said sealed terminal assembly.

(4) A hermetically sealed type electromotively driven compressor and equipment that is provided with a hermetically sealed type electromotively driven compressor where, in the preceding Paragraph No. (1), said lead wire locking member is installed by means of an engagement part on said housing so as to prevent the possible withdrawal of the lead wire.

(5) A hermetically sealed type electromotively driven compressor and equipment that is provided with a hermetically sealed type electromotively driven compressor, characterized in that, in the preceding Paragraph No. (1), a sufficient insulation distance is secured by using a protuberant piece that has been installed on the outer periphery of said housing or on the side that faces the said sealed terminal assembly.

(6) A hermetically sealed type electromotively driven compressor and equipment that is provided with a hermetically sealed type electromotively driven compressor, characterized in that, in the immediately preceding Paragraph No. (1), said housing is made of a resin material and a protuberant piece for securing a sufficient insulation distance is formed integrally.

(7) A hermetically sealed type electromotively driven compressor and equipment provided with a hermetically sealed type electromotively driven compressor, characterized in that, in the preceding Paragraph No. (1), the coolant that is to be charged into said tightly sealed container is a coolant of the natural system (HC coolant).

According to this invention which has been described above, a sufficient insulation distance can be secured even in the case where an abnormal state occurs in the hermetically sealed type electromotively driven compressor with a resultant drop in the insulation resistance. Since it becomes possible to reduce the possibility of such an extremely dangerous accident as earth leakage and sealed terminal jumps that develop in the prior art by securing sufficient insulation pressure resistance, it is possible to reduce the incidence of electrocutions or fires and the development of dangers to humans and buildings due to the blowing of the pin of the sealed terminal assembly, thereby making it possible to offer a more reliable hermetically sealed type electromotively driven compressor and equipment provided with the same.

Moreover, this invention can be realized by merely changing some of the parts of the protector for hermetically sealed type electromotively driven compressors without changing the current hermetically sealed type electromotively driven compressor.

It is intended that the invention include all modifications and equivalents of the described embodiments falling within the scope of the appended claims.

What is claimed:

1. A protective device for a hermetically sealed compressor driven by an electric motor having a terminal assembly mounted in a sealed casing of the compressor, the terminal assembly having terminal pins extending through electrically insulating material, the terminal pins extending from the terminal assembly both inside and outside the casing comprising, a protective device housing formed of electrically insulating material, the protective device housing having a bottom wall formed with terminal pin receiving holes for mounting the protective device on the terminal pins of the terminal assembly, sidewalls extending upwardly from the bottom wall defining a motor protector seat and motor lead guideways, a motor protector disposed in the motor protector seat, electrically conductive terminal pin connectors mounted in the protective device housing and a fuse element interconnected with the motor protector, a skirt member formed of electrically insulating material extending outwardly from the sidewalls of the protective device housing on a side of the protective device housing facing the sealed casing of the compressor when the protective device is mounted on the terminal pins of the terminal assembly, the skirt member extending beyond the sidewalls of the protective device housing a selected distance to provide at least a predetermined insulation distance between electrically conductive parts of the protective device and electrically conductive parts of the sealed casing of the compressor and to block the direct electrical discharge path between electrically conductive parts of the protective device and electrically conductive parts of the sealed casing of the compressor.

2. A protective device according to claim 1 in which the skirt member provides an insulation distance of at least 9.5 mm.

3. A protective device according to claim 1 in which the skirt member is formed of resinous material.

4. A protective device according to claim 1 further comprising a motor lead locking mechanism for locking a motor lead in a respective guideway.

5. A protective device according to claim 4 in which the skirt member is received on the bottom wall of the protective device housing and further comprising a top wall formed on the protective device housing over the motor lead guideways, the bottom wall of the protective device housing having a respective hole therethrough communicating with each motor lead guideway and the motor lead locking mechanism includes cantilever beam members formed in the skirt member by a slot, each beam aligned with a respective guideway and having a movable free end, a wedge-shaped portion formed on the free end of each beam, the wedge-shaped portion of a respective beam received in a hole of each guideway with the beam at an at rest position, the wedge-shaped portion having a stop surface so that a motor lead connector connected to a motor lead inserted into the guideway biases the wedge-shaped portion downwardly and, when the motor lead connector goes beyond the wedge-shaped portion in the guideway, the beam returns to its at rest position with the stop surface locking the motor lead connector in the guideway.

6. A protective device according to claim 5 further comprising a latch extending from the skirt member and the bottom wall of the protective device housing is formed with a latch receiving hole, the latch being received in the latch receiving hole to attach the skirt member to the protective device housing.

7. A protective device according to claim 1 further comprising a latch extending from the skirt member and the bottom wall of the protective device housing is formed with a latch receiving hole, the latch being received in the latch receiving hole to attach the skirt member to the protective device housing.

8. A protective device according to claim 1 in which the skirt member is integrally formed with the protective device housing.

9. Electromotively driven compressor apparatus comprising a sealed casing having a terminal assembly mounted in a wall of the sealed casing, terminal pins mounted in the terminal assembly electrically isolated from one another and from the sealed casing, the terminal pins extending from the terminal assembly both inside and outside the sealed casing, an electric motor and a compressor mounted in the sealed casing, the compressor driven by the motor, a protective device mounted on the terminal pins of the terminal assembly within the sealed casing, the protective device having a protective device housing formed of electrically insulating material, the protective device housing having a bottom wall formed with terminal pin receiving holes for mounting the protective device on the terminal pins of the terminal assembly, sidewalls extending upwardly from the bottom wall of the protective device housing defining a motor protector seat, a motor protector disposed in the motor protector seat, electrically conductive terminal pin connectors mounted in the protective device housing and a fuse element interconnected with the motor protector, a skirt member formed of electrically insulating material extending outwardly from the sidewalls of the protective device housing on a side of the protective device housing facing the sealed housing of the compressor when the protective device is mounted on the terminal pins of the terminal assembly, the skirt member extending beyond the sidewalls of the protector device housing a selected distance to provide at least a predetermined insulation distance between electrically conductive parts of the protective device and electrically conductive parts of the sealed casing of the compressor and to block direct electrical discharge path between electrically conductive parts of the protective device and electrically conductive parts of the sealed casing of the compressor.

10. Electromotively driven compressor apparatus according to claim 9 in which the skirt member provides an insulation distance of at least 9.5 mm.

11. Electromotively driven compressor apparatus according to claim 9 further comprising a pressurized natural system coolant disposed within the sealed casing.

12. Electromotively driven compressor apparatus according to claim 9 further comprising a condenser, an expansion mechanism and an evaporator interconnected with each other and with the compressor.

* * * * *